United States Patent [19]

Thompson

[11] 4,284,394

[45] Aug. 18, 1981

[54] GAS MANIFOLD FOR PARTICLE QUENCHING

[75] Inventor: Charles C. Thompson, Jupiter, Fla.

[73] Assignee: United Technologies Corporation, Hartford, Conn.

[21] Appl. No.: 188,447

[22] Filed: Sep. 19, 1980

[51] Int. Cl.[3] ..... B22F 9/00

[52] U.S. Cl. ..... 425/8; 264/8

[58] Field of Search ..... 425/8; 264/8, 14

[56] References Cited

U.S. PATENT DOCUMENTS

| | | | |
|---|---|---|---|
| 4,025,249 | 5/1977 | King | 425/8 |
| 4,053,264 | 10/1977 | King | 425/8 |
| 4,078,873 | 3/1978 | Holiday | 425/8 |

*Primary Examiner*—Donald E. Czaja
*Assistant Examiner*—James R. Hall
*Attorney, Agent, or Firm*—Stephen E. Revis

[57] ABSTRACT

In apparatus for producing metal powder by rapid solidification of molten metal particles flung into a quenching chamber from a rotating disk through vertical zones of cooling fluid, improved cooling fluid flow, improved operating efficiency and low pressure losses are provided by having the cooling fluid introduced into the quenching chamber via a plurality of cylindrical tubes each having an inlet within a coolant fluid manifold and an outlet opening into the quenching chamber. Each tube including means for creating a cooling fluid vortex flow therein which exits from the tube outlet into the quenching chamber as an expanding cone of swirling fluid. A plurality of these tubes are appropriately located around the rotating disk to create a desired pattern of cooling fluid flow around the disk and through which the molten metal particles will pass as they solidify into the powder.

9 Claims, 6 Drawing Figures

GAS MANIFOLD FOR PARTICLE QUENCHING

The Government has rights in this invention pursuant to Contract No. F33615-76-C-5136 awarded by the Department of the Air Force.

DESCRIPTION

Technical Field

This invention relates to the formation of metal powders which are cooled at high rates.

It is well known in the art to form metal powders by pouring molten metal onto a spinning disk which flings molten metal droplets outwardly into a quenching chamber in a substantially horizontal plane through concentric annular curtains of coolant fluid surrounding the spinning disk. The droplets of molten metal, as they are flung off the disk and pass through the cooling fluid, are very rapidly cooled to form metal particles. The heat released from the solidifying particles, as they travel radially outwardly from the edge of the rotating disk, is a function of the material being processed, the metal superheat, the particle size distribution generated by the rotating disk, and the particle radial velocity. Generally, the released heat flux is greatest near the rotating disk and decreases exponentially with increasing radius. To minimize the cooling gas flow rate for a given allowable cooling fluid temperature rise, the mass flux of the cooling fluid should vary radially in the same manner as the released heat flux from the particles. Prior art apparatus introduces the cooling fluid as a plurality of concentric, vertically moving annular zones each having a different mass flux profile such that the radial released heat flux profile from the particles is approximately matched in a stepwise manner.

Two patents representative of the prior art are commonly owned U.S. Pat. Nos. 4,053,264 to J. A. King and 4,078,873 to Paul R. Holiday and Robert J. Patterson. In both of these patents three separate annular cooling fluid manifolds include nozzle means associated therewith for directing the cooling fluid in a desired pattern downwardly into the quenching chamber around the rotating disk. Control of the cooling fluid flow rate is accomplished, in part, by controlling the fluid pressures within the individual annular manifolds. Concentric annular nozzles and rings of circular metering holes are utilized to produce three radial zones of different mass flux that approximate the required radial heat flux variations. High flow rates and pressure drops across the metering holes and annular nozzles are required to achieve the desired radial and circumferential control of the mass flux flow and to ensure turbulent mixing of fluid flows through adjacent nozzles such that a reasonably uniform curtain of gas crosses the particle path and good cooling results.

The foregoing apparatus is satisfactory if large quantities of cooling fluid at high pressures are continuously available. To conserve coolant and thereby improve the economics of the powder production process, a closed-loop cooling fluid system is highly desirable; however, such a system requires flow rates and pressure losses significantly less than those required by the prior art; and cooling gas distribution and control thereby becomes more difficult. The simple, axially-flowing holes and annular nozzles of the prior art are inadequate for low pressure drop systems because fluid flowing at low flow rates through these apertures lacks sufficient momentum and turbulence to fill in the areas between the holes and nozzles.

DISCLOSURE OF INVENTION

An object of the present invention is improved apparatus for creating predetermined zones of cooling fluid in apparatus for producing metal powder by rapid solidification of molten metal droplets.

Another object of the present invention is a low pressure coolant fluid system for rapid solidification rate metal powder producing apparatus wherein a single pressurized manifold provides the coolant to a plurality of nozzles which generate the desired pattern of coolant fluid flow.

It is a further object of the present invention to provide improved cooling fluid flow apparatus for a rapid solidification rate metal powder producing system wherein the cooling fluid flow apparatus operates efficiently at low flow rates, with low pressure losses, and in a closed-loop cooling fluid system.

According to the present invention apparatus is provided for producing metal powder by rapid solidification of molten metal particles flung into a quenching chamber from a rotating disk through vertical zones of cooling fluid, wherein the cooling fluid enters the chamber from a plurality of cylindrical tubes each having an outlet which opens into the quenching chamber and an inlet which is disposed within a coolant fluid manifold, each tube including means for creating a cooling fluid vortex flow inside the tube which exits from the outlet thereof as an expanding cone of swirling fluid.

In one embodiment all the tube inlets communicate with a common cooling fluid manifold. The tubes are located on the circumference of appropriately spaced apart concentric circles and have their swirling cooling fluid cones intersecting each other in the quenching chamber at a relatively short distance below the tube outlets to form continuous annular zones of cooling fluid flow moving downwardly through the quenching chamber around the rotating disk.

The tube inlets are preferably slots through the tube wall substantially tangential to the tube inner cylindrical wall surface. These inlets result in the vortex flow of fluid within the tube. The slot area, which is generally smaller than the cross sectional area of the tube, controls the pressure drop and fluid flow rate through the tube from the cooling fluid manifold to the quenching chamber. Properly sized tubes and slots result in an expanding conical swirling flow from each tube outlet with a relatively low pressure drop.

Thus, with this invention, low fluid flow rates and low pressure drops through the tubes may be used since turbulent flow from the tube outlets is not required to fill in gaps between the adjacent tubes. A common cooling fluid manifold may be used for the entire apparatus since precise control of the pressure drop through each tube is accomplished by appropriately sizing the tube inlet slots. The half cone angle of the fluid exiting from the tubes is directly related to the ratio of the inlet slot area to the tube cross-sectional area, and can, therefore, be easily determined and preselected such that the vertical location where the cones intersect may be closely estimated and the correct tube spacing can readily be determined.

The foregoing, and other objects, features and advantages of the present invention will become more apparent in the light of the following detailed description of the preferred embodiment thereof as shown in the accompanying drawing.

BEST MODE FOR CARRYING OUT THE INVENTION

Figure 1A:
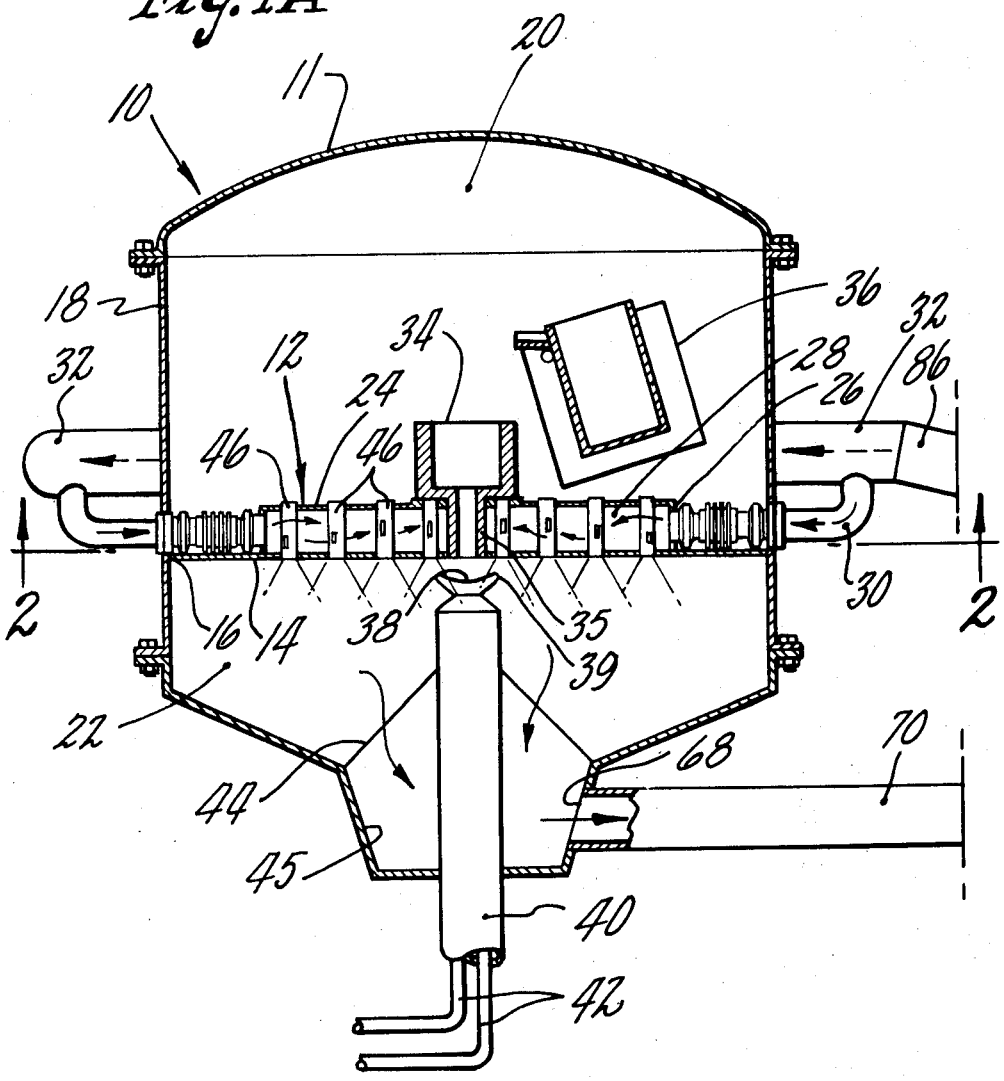
FIG. 1 (FIGS. 1A and 1B) is a cross-sectional view of metal powder making apparatus according to the present invention.

Referring first to FIG. 1A, rapid solidification rate metal powder making apparatus comprises a housing 10 having a removable cover 11 or other suitable means for providing access to the interior of the housing. Disposed within the housing 10 is manifold means 12. The manifold means 12 includes a circular nozzle plate 14 whose outer periphery 16 is in sealing engagement with the cylindrical sidewall 18 of the housing 10 thereby dividing the housing into an upper chamber 20 and a lower quenching chamber 22. The manifold means 12 also includes an upper circular plate 24 and a cylindrical sidewall 26 which defines, with the lower nozzle plate 14, a cooling fluid manifold volume or plenum 28. Four cooling fluid supply lines 30 equally spaced around the periphery of the wall 26 feed cooling fluid, typically helium gas, to the manifold volume 28 from a torroidal conduit 32 surrounding the housing 10.

Disposed within the upper chamber 20 of the housing 10 is a tundish 34 having a nozzle 35. The tundish is supported by the upper plate 24 of the manifold means 12. The tundish is heated by any suitable means (not shown), such as by means described in hereinabove referred to U.S. Pat. Nos. 4,053,264 and 4,078,873. Also disposed in the upper chamber 20 is a melting furnace 36 rotatably supported within the housing 10 (by means not shown) for pouring molten metal into the tundish 34. Neither the tundish, the melting furnace, nor the means for rotatably supporting the melting furnace are considered as novel features of the present invention. They may, for example, be designed in accordance with the teachings of either of the hereinabove referred to U.S. Pat. Nos. 4,053,264 and 4,078,873 which are incorporated herein by reference.

A rotating dish-like disk 38 having a rim 39 is mounted for rotation in the quenching chamber 22 directly below the tundish nozzle 35 for receiving molten metal from the furnace 36. The rotating disk is supported at the top of an upstanding pedestal 40 and is rotated by any suitable means, such as by an air turbine (not shown) disposed within the pedestal 40. The tubes 42 shown extending from the bottom of the pedestal 40 provide power to operate the turbine and cooling fluid to cool the rotating disk. Struts 44 support and position the pedestal 40 within a funnel-like cavity 45 in the bottom of the housing 10. The rotating disk, the means for rotating the disk, and the means for cooling the disk are not considered to be novel features of the present invention.

Figure 2:
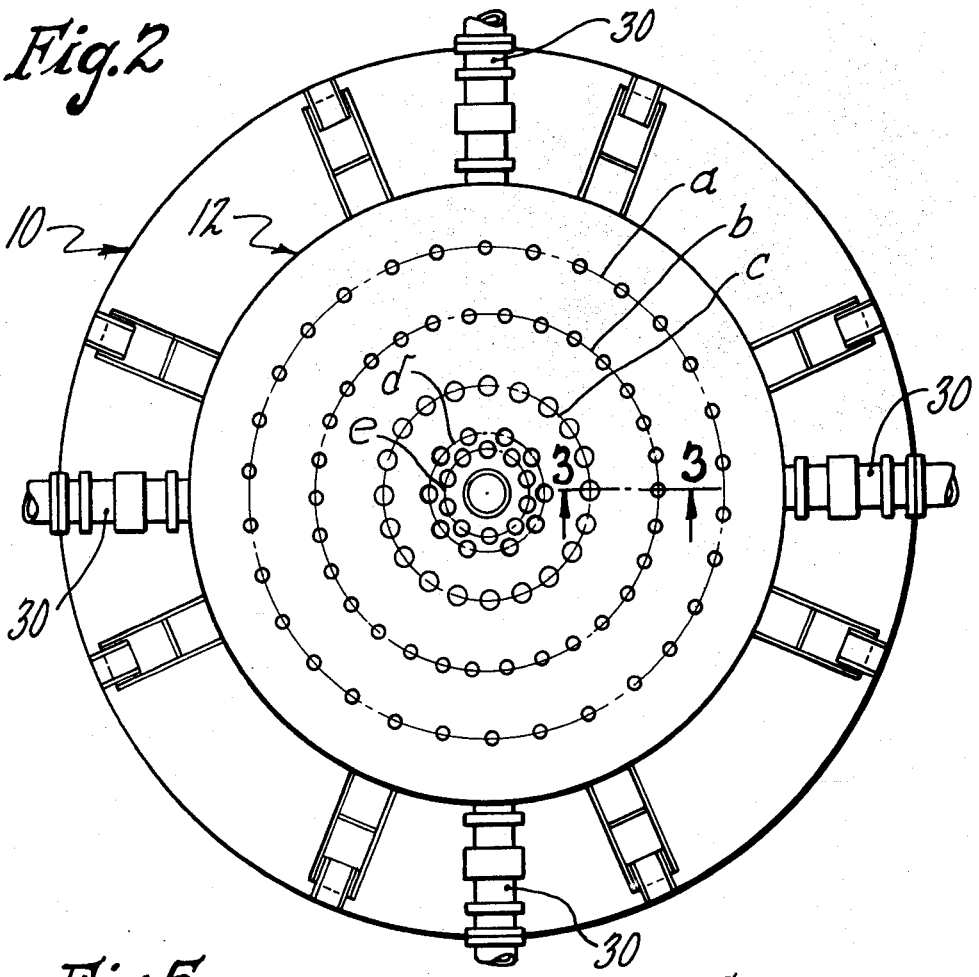
FIG. 2 is a cross-sectional view taken along the line 2—2 of FIG. 1A.

Disposed within the manifold volume 28 are a plurality of vertically-oriented vortex tubes 46 with slots 47 (FIG. 3) through the walls 48 thereof providing gas communication from the manifold volume 28 to the interior of the tubes. In this embodiment, the tubes extend between the upper and lower manifold plates 24, 14, respectively, and are arranged in a pattern of five concentric circles having a common center on the axis of the rotating disk 38, as best shown in FIG. 2. These rings are labeled a, b, c, d, and e from largest to smallest, respectively. Although arranging the tubes in concentric rings is preferred, other arrangements may also provide the desired cooling flow pattern and are intended to fall within the scope of the present invention.

The upper end 50 of each tube is welded into a circular hole 51 through the plate 24. The weld forms a seal around the tube between the upper chamber 20 and the manifold volume 28. Similarly, the lower end 52 of each tube 46 is welded around its periphery to a hole 54 through the nozzle plate 14. The weld provides a seal around the tube between the manifold volume 28 and the quenching chamber 22. The outlet 56 of each tube 46 opens into the quenching chamber 22 and, in this embodiment, is substantially flush with the bottom surface 58 of the nozzle plate 14. A plug 60 disposed inside the upper end 50 of the tube 46 provides a seal between the upper chamber 20 and the interior of the tube 46 below the plug 60. It is readily removable to facilitate cleaning the tubes. A more detailed discussion of the operation and construction of the manifold 12 and the vortex tubes 46 is set forth hereinbelow.

In this preferred embodiment, the cooling fluid system is a closed-loop recirculating system wherein the cooling fluid is helium gas. The manifold volume 28 is a common pressure source and the quenching chamber 22 is a common pressure sink for all the tubes. The pressure drop experienced by each tube from its inlet to its outlet is, therefore, the same; and the flow rate through each tube is easily controlled by tube inlet and outlet areas. Thus, complicated valving and pressure regulating equipment required by the prior art to control flow rates from a plurality of nozzles associated with different plenums are not necessary with this invention.

Figure 1B:
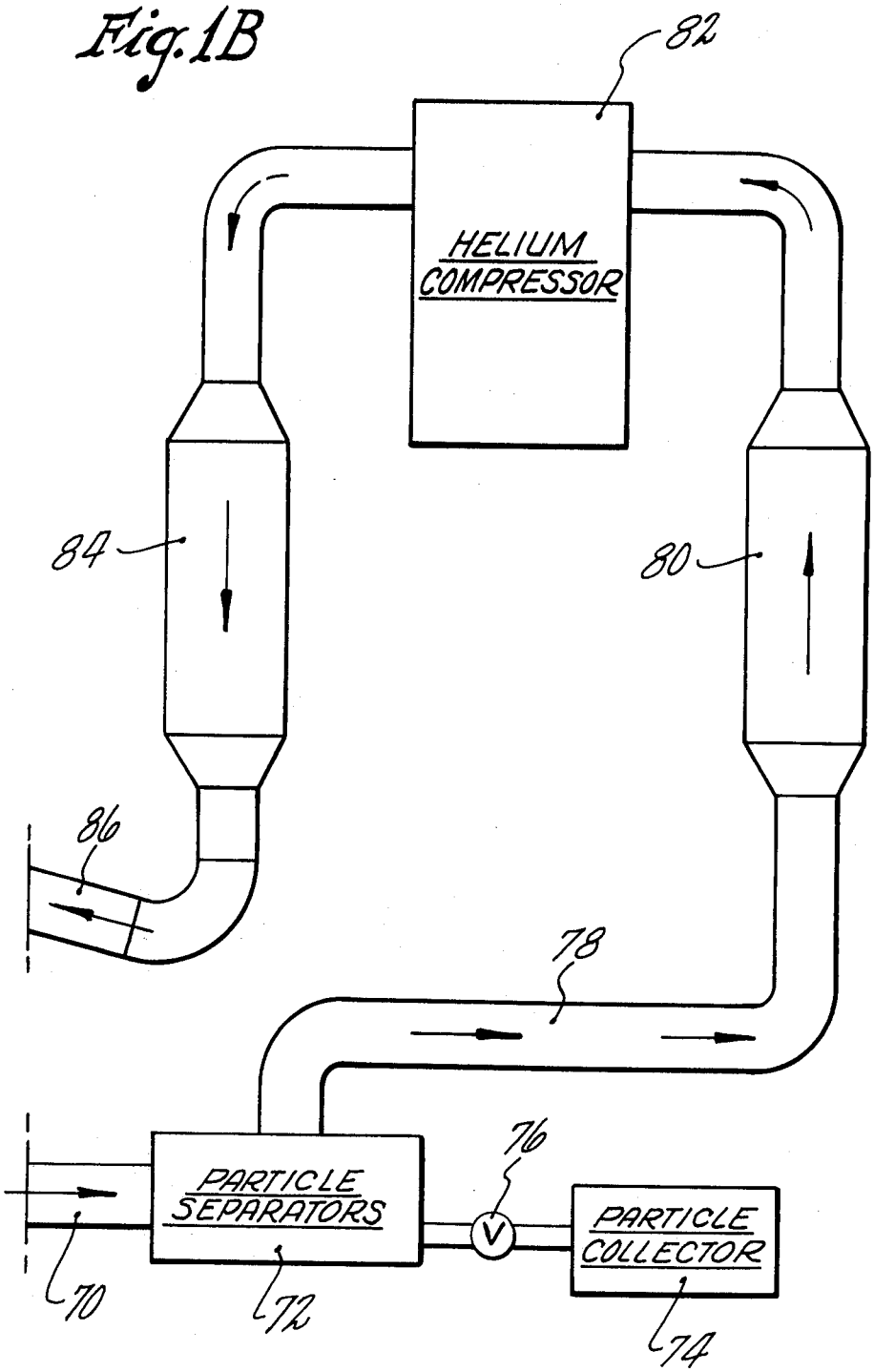

As shown in FIGS. 1A and 1B, the helium gas enters the manifold volume 28 via the supply lines 30, passes into each of the vortex tubes 46 via the slots 47 therein, enters the quenching chamber 22 via the tube outlets 56, and leaves the quenching chamber 22 (along with the powder metal particles formed during the process) via an outlet 68 at the bottom of the housing 10 which is connected to an exhaust conduit 70. The exhaust conduit 70 is connected to a bank of particle separators connected in parallel and represented by the block 72. These separators remove the metal particles from the helium gas stream and deposit them in a collector 74 which can be sealed off by an on-off valve 76 for purposes of powder transportation.

Particle-free gas passes from the separators 72 via a conduit 78, and thence into a first-heat exchanger 80 which removes the thermal energy transferred to the gas by the hot particles, such that the inlet temperature to the following cooling gas compressor/circulating pump 82 is 29° to 32° C. imder normal operating conditions. The compressor 82 boosts the cooling gas to its desired operating pressure, and this compressed gas is fed to a second heat exchanger 84 to remove the heat of compression and reduce the gas temperature to between 26° and 29° C. before feeding it to the torroidal conduit 32 via the conduit 86.

Figure 4:
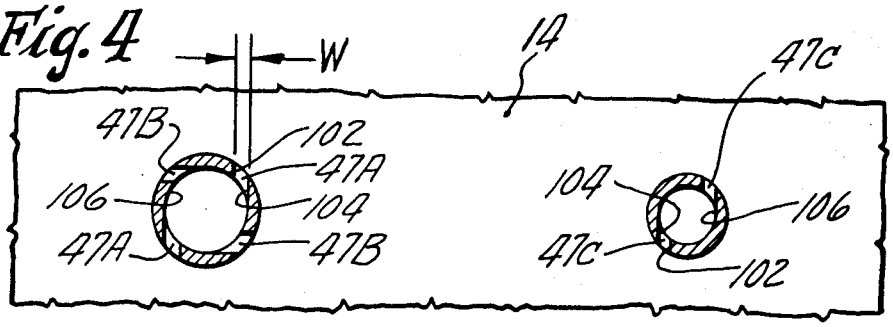
FIG. 4 is a cross-sectional view taken along the line 4—4 of FIG. 3.
Figure 3:
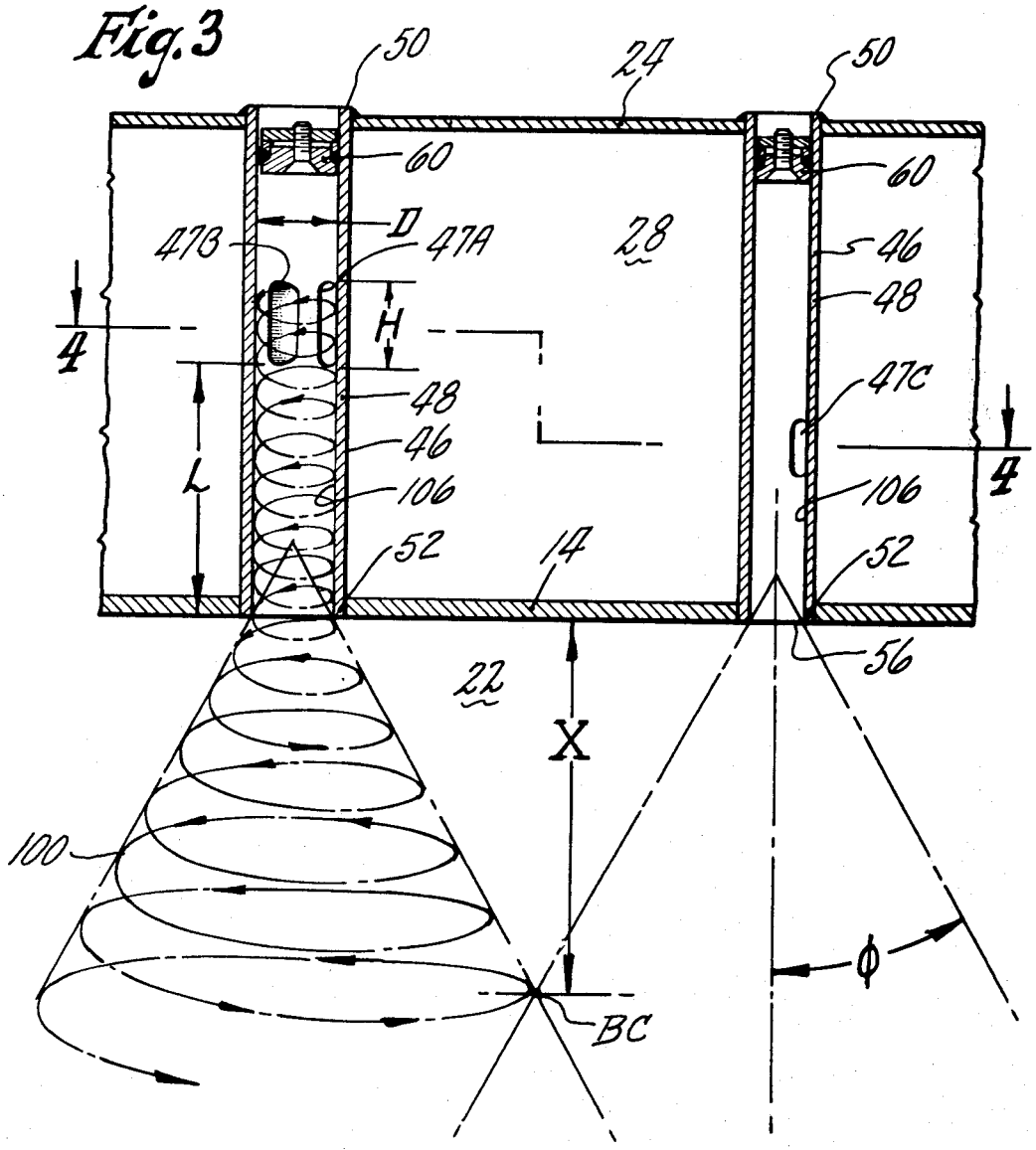
FIG. 3 is a cross-sectional view taken along the line 3—3 of FIG. 2.

A clearer understanding of the operation and construction of the vortex tubes 46 may be had by referring to FIGS. 3 and 4. In this invention, it is required that the cooling gas exit each tube 46 into the quenching chamber 22 as an expanding, swirling cone 100 as depicted in FIG. 3. This is accomplished by creating a vortex flow of the gas within each tube. For example, in this embodiment the tubes 46 include either one or two pair of diametrically opposed, vertically elongated, rectangular slots having a height H and a width W. The tubes 46 in circles a, b and c have two pair each; and the tubes 46 in circles d and e have one pair each. In FIGS. 3 and 4 the right hand tube 46 is from circle c and has two pairs of slots labeled 47A and 47B, respectively. The tube on the left is from circle d and has one pair of slots 47C. As shown in FIG. 4, each slot comprises a pair of parallel sidewalls 102, 104, with one of the sidewalls 104 of each slot being substantially tangential to the inner cylindrical wall surface 106 of the tube 46. Thus, cooling gas entering the tube from the manifold volume 28, is directed substantially tangential to the wall surface 106, and creates the desired vortex flow within the tube.

Whether or not a cone of the type described is formed at the outlet 56 is a function of (1) the tangential velocity of the flow entering the slots 47 as measured at the wall surface 106; (2) the axial velocity of the flow (which is the ratio of the volume flow rate to the area of the outlet 56); and (3) the ratio of the effective tube length L to the tube inner diameter D, where the effective tube length L is the axial distance from the tube outlet to the bottom of the slot. For tubes of the sizes we have been using, the length of tube from the top of the slot 47 to the plug 60 does not significantly affect the rate or manner in which the cooling fluid flows through the tube. However, if it did, any effect could be eliminated by locating the plug 60 at the top of the slot 47.

For small ratios of $^{L}/_{D}$, say less than 5.0, a close approximation for determining the half-cone angle Φ of the cone 100 of swirling gas is:

$$\Phi = -1\frac{A_t}{A_s} \qquad \text{(Equation 1)}$$

$A_s$ is the sum of the cross-sectional areas of the tube slots, the area of each slot being measured in a plane perpendicular to the slot wall surfaces 102, 104, and parallel to the tube axis. $A_t$ is the internal cross-sectional area of the tube 46 perpendicular to its axis. For adjacent tubes of know geometry, the distance below their outlets at which their cones of cooling gas will intersect can easily be predicted or at least closely approximated. A more detailed discussion concerning flow from the exit of a cylindrical vortex tube may be found in a paper titled "Experimental Investigation of the Structure of Vortices in Simple Cylindrical Vortex Chamber" by Donaldson and Snedeker, Aero. Res. Associates of Princeton, Report No. 47, December 1962.

As earlier discussed, the apparatus of the present invention is for forming metal powder by rapidly solidifying molten metal droplets. The droplets are formed by pouring molten metal onto a rotating disk which flings the metal radially outwardly in a substantially horizontal plane approximately parallel to the plane of the disk rim. The droplets pass through cooling fluid surrounding the disk and are cooled at a rate which is determined by the mass flux of the cooling gas through which they pass, which preferably varies radially in the same manner as the released heat flux from the particles. In any event, in the present invention, the cooling rate will be determined by the number, size, construction, and location of the vortex tubes. Whatever the pattern of cooling gas flow from the tubes into the quenching chamber, it is critical that, in the plane of the moving metal droplets, essentially the same gas flow exists at the same radial location 360° around the disk. Otherwise, different particles will be subjected to different cooling rates, and even particles of the same size will have different properties.

In the present invention, the flow from each vortex tube forms downwardly expanding cones. Gaps exist between adjacent cones above the point where the cones intersect. It is thus required that tubes disposed on the same circle a, b, c, d, or e be spaced apart in such a manner that the cones from adjacent tubes intersect at a point above the plane in which the metal droplets are traveling, which is approximately the plane of the disk 38. Below that intersection point the cones form a continuous, vertically moving annular ring or curtain of coolant through which the metal droplets must pass. Similarly, the spacing between the concentric rings a, b, c, d, and e of tubes should be such that the cones from adjacent concentric rings also intersect above the plane in which the droplets are traveling to avoid any gaps in cooling gas flow between the concentric annular rings of coolant. In other words, if the swirling fluid cone from each tube intersects the cones from all adjacent surrounding tubes at a point whose perpendicular distance from the plane of the tube outlets is less than the perpendicular distance from the disk to the plane of the tube outlets, no gaps in cooling fluid flow will exist in the plane of travel of the metal particles.

Figure 5:
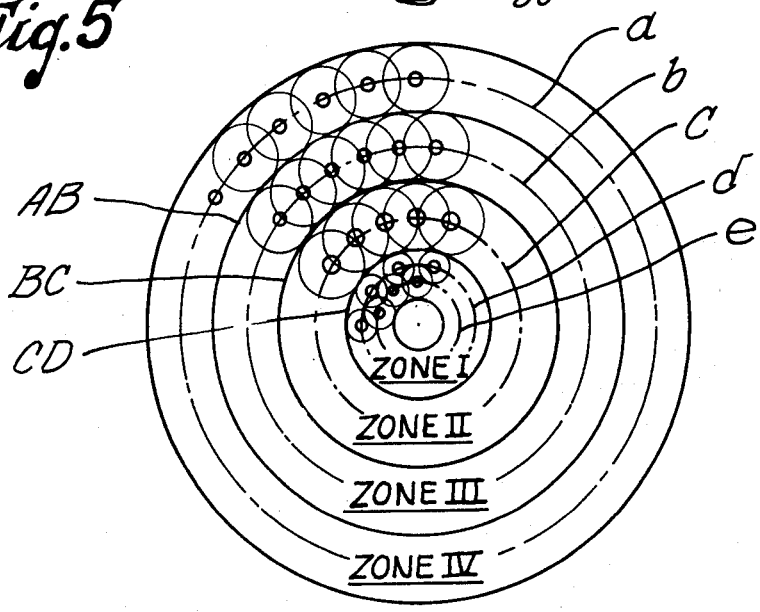
FIG. 5 is a diagramatic view showing the creation of zones of cooling fluid by the apparatus of the present invention.

The foregoing is best illustrated in FIGS. 3 and 5 wherein the cones generated by the tubes on the two outermost concentric circles a and b intersect on the circumference of a circle AB. In like fashion, the cones generated by the tubes on the two circles b and c intersect on the circumference of a circle BC; and the cones generated by the tubes on the circles c and d intersect on the circle CD. It is apparent that the tubes on each circle a, b, c, d, and e can be constructed, and the diameter of these circles can be selected, such that the intersection circles AB, BC, and CD are of preselected diameter, and the planes of these circles are located at a preselected distance ($X_1$, $X_2$, $X_3$, respectively) below the tube outlets 56. Furthermore, it is possible to construct, size and arrange the tubes such that the planes of some or all of these intersection circles are located at the same distance (i.e. $X_1=X_2=X_3$) below the tube outlets 56, though this is not required. What is required, however, is that the cones intersect above the path of travel of the molten particles being flung radially off the rotating disk 38.

In the preferred arrangement shown, annular zones of cooling fluid (labeled, I, II, III and IV in FIG. 5) are created between the adjacent intersection circles. (Zone IV, in this embodiment, is considered as a combination of the cooling flow from the tubes on circles d and e, which are very closely spaced.) The molten metal particles must pass through each of these zones as they cool. The cooling rate in each zone is controlled by the number of tubes in each zone and the cooling flow rate through the individual tubes. In this embodiment, the tubes in any one circle a, b, c, d and e are identical, but the tubes may be different from circle to circle.

Table I provides dimensional data and process operating data for the apparatus depicted in the drawing. The data in Table I is for a total helium flow rate of 1.00 lbm/sec, a helium temperature of 80.0° F. in the manifold volume, and a constant manifold plenum pressure of 17.1 psia. The pressure loss for the entire closed-loop system is only about 2.5 psi. Pressure loss from the supply line 30 to the quenching chamber 22 is only 1.00 psi. For comparison purposes, a system such as that shown in U.S. Pat. No. 4,078,873 utilized a helium flow rate of 1.0 lbm/sec and had an overall pressure loss of 10 psi.

TABLE I

| Parameter | Zone I | Zone II | Zone III | Zone IV |
|---|---|---|---|---|
| Outer Zone Radius (in.) | 6.3 | 12.6 | 18.9 | 25.2 |
| No. Tubes In Zone | 20 | 20 | 30 | 30 |
| Slot Width W (in.) | 0.107 | 0.133 | 0.152 | 0.128 |
| Slot Height H (in.) | .958 | 0.941 | 0.604 | 0.506 |
| Tube Inner Diameter D (in.) | 0.856 | 1.060 | 0.607 | 0.510 |
| L/D | 3.27 | 3.16 | 3.05 | 3.05 |
| $A_t/A_s$ | 1.43 | 1.82 | 1.67 | 1.67 |
| Per Tube Flow Rate (lbm/sec) | 0.0155 | 0.0187 | 0.0062 | 0.0044 |
| Axial Velocity (ft/sec) | 366. | 266. | 270. | 269. |
| Tangential Velocity (ft/sec) | 480. | 484. | 451. | 448. |
| Cone Half Angle Φ (degrees) | 55 | 61 | 59 | 59 |

Note that the L/D ratio is similar for all tubes. Also, $A_t/A_s$ for the tubes are not too different, such that the cone half angles Φ are almost the same.

This particular apparatus can produce nickel base super alloy powder from the molten metal at a rate of about one-third pound per second. The mass flux of the cooling gas in the four cooling zones I, II, III, and IV approximates, stepwise, the radial variation of the heat flux released from the molten metal as it is processed. A closer approximation could, of course, be achieved by using additional circles of vortex tubes; however, the cost of adding additional circles of tubes eventually outweighs any benefits to be gained by achieving a better match between the particle released heat flux profile and the radial mass flux profile of the cooling gas.

Although the invention has been shown and described with respect to preferred embodiments thereof, it should be understood by those skilled in the art that various changes and omissions in the form and detail thereof may be made therein without departing from the spirit and the scope of the invention.

I claim:

1. Apparatus for producing metal powder comprising:

a housing;

disk means within said housing mounted for rotation about an axis;

nozzle plate means disposed within said housing;

means defining a cooling fluid manifold volume on one side of said plate means;

means defining a quenching chamber on the other side of said plate means;

a plurality of cylindrical vortex tubes each having wall means defining an inner cylindrical wall surface, at least a first portion of each of said tubes being disposed within said manifold, each of said tubes including means for admitting cooling fluid from said manifold volume into said tube and for creating a vortex flow of said fluid within said tube, each of said tubes having cooling fluid outlet means opening into said quenching chamber, said tubes being constructed, sized, and arranged to create a desired pattern of cooling fluid flow from said outlets into said quenching chamber around said disk means.

2. The apparatus according to claim 1 wherein said tubes are arranged around the circumference of a plurality of concentric circles having said disk axis as a center to create a plurality of concentric annular zones of cooling fluid surrounding said disk means.

3. The apparatus according to claim 2 wherein the number of tubes in each circle and the construction and size of each tube is selected such that the mass flux of the cooling fluid in the quenching chamber stepwise approximates the radial variation of the heat flux expected to be released by the metal to be processed.

4. The apparatus according to claim 1 wherein said manifold volume is a common pressure source and said quenching chamber is a common pressure sink for all of said tubes.

5. The apparatus according to claims 1, 2, 3, or 4 wherein said means for admitting cooling fluid and creating a vortex flow of said fluid within each of said tubes comprises at least one slot through said wall means of said tube substantially tangential to said tube inner cylindrical wall surface for providing cooling fluid flow from said manifold volume into said tube substantially tangential to said tube inner wall surface.

6. The apparatus according to claim 4 including closed-loop cooling fluid recirculation means comprising means for introducing cooling fluid under pressure into said manifold volume, means for removing cooling fluid from said quenching chamber, means for removing heat added to the cooling fluid during operation of the apparatus, and means for recirculating said fluid.

7. The apparatus according to claim 4 wherein said tube outlet means are above the plane of said disk means, and said tubes are oriented for directing cooling fluid from said outlet means downwardly around said disk means.

8. The apparatus according to claim 7 wherein said tubes are arranged around the circumference of a plurality of concentric circles having said disk axis as a center, said means for admitting cooling fluid and creating a vortex flow of cooling fluid within each of said tubes comprises slots means through said wall means of each tube substantially tangential to said tube inner cylindrical wall surface for providing cooling fluid flow from said manifold volume into said tube substantially tangential to said tube inner wall surface, the number of tubes in each circle and the construction and size of each tube being selected such that the mass flux of the cooling fluid in the quenching chamber will stepwise approximate the radial variation of the heat flux which is expected to be released by the metal to be processed, said apparatus also including close-loop cooling fluid recirculation means comprising (1) means for introducing cooling fluid under pressure into said manifold volume; (2) means for removing cooling fluid from said quenching chamber; (3) means for removing heat from said cooling fluid, and (4) means for recirculating said fluid.

9. The apparatus according to claims 1, 2, 3 or 4 wherein said tubes are constructed to generate expanding cones of swirling cooling fluid from said outlet means into said quenching chamber, and the number and arrangement of said tubes are such that each cone of fluid intersects the cones from adjacent surrounding tubes at a perpendicular distance from the plane of said outlet means which is less than the perpendicular distance from said disk means to said plane.

* * * * *